US005100618A

United States Patent [19]

Dewing et al.

[11] Patent Number: 5,100,618

[45] Date of Patent: Mar. 31, 1992

[54] PRODUCTION OF AN ALUMINUM GRAIN REFINER

[75] Inventors: Ernest W. Dewing, Kingston; Stephen H. Keeley, Lansdowne; John Sulzer, Kingston; Pervez J. Bamji, Kingston, all of Canada

[73] Assignee: Alcan International Limited, Montreal, Canada

[21] Appl. No.: 517,359

[22] Filed: May 1, 1990

[30] Foreign Application Priority Data

May 3, 1989 [CA] Canada ..... 598584

[51] Int. Cl.[5] ..... C22C 21/00

[52] U.S. Cl. ..... 420/528; 75/678; 75/684; 266/216; 266/234; 148/437; 420/552

[58] Field of Search ..... 148/437; 75/671, 678, 75/684; 266/216, 234; 420/528, 552

[56] References Cited

U.S. PATENT DOCUMENTS 3,272,617 9/1966 Fennell ..... 75/379
3,961,995 6/1976 Alliot et al. ..... 148/437
4,298,377 11/1981 Szekely ..... 75/560
4,484,371 11/1984 Taniguchi ..... 266/216
4,834,942 5/1989 Frazier et al. ..... 148/437

*Primary Examiner*—R. Dean
*Assistant Examiner*—Robert R. Koehler
*Attorney, Agent, or Firm*—Cooper & Dunham

[57] ABSTRACT

A process is described for producing an aluminum grain refiner, such as Al-Ti-B grain refiner. Molten aluminum is continuously flowed as a bottom layer along a substantially horizontal or slightly inclined trough. Titanium or boron compounds reducible by aluminum or a mixture of such compounds is added to the surface of the aluminum layer such that a discrete separate layer of these is formed on top of the aluminum layer. Reaction between the aluminum and the titanium and/or boron compounds occurs along the interface between the layers and this reaction may, if desired, be aided by providing relative movement between the layer of molten aluminum and the layer of titanium and/or boron compounds. A surface layer of spent reaction product is removed and a stream of aluminum alloyed with titanium and boron is collected.

16 Claims, 3 Drawing Sheets

FIG. 8
50X

FIG. 9
50X

PRODUCTION OF AN ALUMINUM GRAIN REFINER

BACKGROUND OF THE INVENTION

This invention relates to a process for the production of an aluminum grain refiner and, more specifically, to an Al-Ti-B grain refiner.

Typically, aluminum grain refiner alloys of the type contemplated by the present invention consist essentially of 2–12 wt % titanium, either alone or together with 0.1–2 wt % boron, and the balance being commercial grade aluminum with normal impurities. Such Al-Ti-B grain refiner alloys are conventionally produced batchwise in an electric induction furnace. The alloying ingredients are typically provided in the form of metal salts preferably in the form of the double fluoride salts of titanium and boron with potassium.

In the typical batch process, a mixture of fluoride salts in the required proportion is fed to a stirred body of molten aluminum in an induction furnace at a temperature in the range of about 700°–800° C. By means of an electro-magnetic stirring action, the salt mixture is drawn below the surface of the melt where a reduction to Ti and B by the Al takes placed. This alloying reaction results in a product which comprises molten potassium alumium fluoride. Periodically during the alloying process, and at the end of the process, electric power is shut off to allow the molten reaction products to rise to the surface of the molten metal where they form a discrete slag layer. This slag layer is removed by decanting into a suitable receptable, such as a slag pan.

The batch of molten alloy thus obtained may be transferred to a separate casting furnace. This is typically an electric induction furnace in which electro-magnetic stirring helps to keep the insoluble $TiB_2$ particles suspended within the molten alloy body. The alloy may be cast into either an ingot for further working to rod by rolling or by extruding or directly into a rod casting machine, such as a Properzi caster.

The above known process has a number of significant disadvantages. Firstly, the product quality, particularly microstructure and grain refining properties, varies from batch to batch. Secondly, the alloying process produces environmentally damaging fluoride-containing fumes in the form of intense emissions for a short period of time and this necessitates an expensive emission control system large enough to handle the periodic high emission rates. Thirdly, the system is very capital intensive.

It is known to use continuous alloying processes utilizing a flowing stream of molten metal. For instance, U.S. Pat. No. 4,298,377 discloses a method and apparatus for adding solids to molten metal by continuously feeding both the solids and the metal into a vortex-forming chamber from which the mixture is discharged at the core of the vortex as a free-falling, hollow-centered stream.

U.S. Pat. No. 3,272,617 discloses a method and apparatus for continuosly pouring a stream of molten metal to form a vortex into which a particulate alloying agent is introduced and where the intensity of the vortex is controlled to immerse the additives in the molten metal at any desired rate.

Another method and apparatus are disclosed in U.S. Pat. No. 4,484,731 for continuously treating molten metal with a treatment agent which is continuously introduced into a treating vessel through a supply passage formed through the wall of the vessel. The molten metal is continuously poured into the lip of the vessel and discharged from the lower part of the vessel after addition of the treating agent.

The above techniques involve total mixing of the reactants into a stirred body of molten metal. This creates a significant problem in that the final grain refiner alloy may be contaminated by entrapped globules of molten salt reaction product. It is, therefore, the object of the present invention to provide an improved process for contacting molten aluminum with grain refining compounds while avoiding the above problem of entrapped globules.

SUMMARY OF THE INVENTION

The present invention relates to a process for the production of an aluminum grain refiner containing titanium and/or boron in which molten aluminum is continuously flowed as a bottom layer along a substantially horizontal or slightly inclined trough. Titanium or boron compounds reducible by aluminum or a mixture of such compounds is added to the surface of the aluminum layer such that a discrete separate layer of these is formed on top of the aluminum layer. Reaction between the aluminum and the titanium and/or boron compounds occurs along the interface between the layers and this reaction may, if desired, be aided by providing relative movement between the layer of molten aluminum and the layer of titanium and/or boron compounds. A surface layer of spent reaction product is removed from the surface and a stream of aluminum alloyed with titanium and boron is collected.

The concept of the invention involves maintaining the two separate layers with the actual contact between molten aluminum and the titanium and/or boron compounds occurring only along the interface. It is surprising that reaction between the two layers will occur at an acceptable rate without any relative movement between the layers. For instance, there may be co-current flow without any relative movement. It is also possible to provide some relative movement between the layers. This relative movement between the layers may be achieved by either moving the two layers co-currently at different rates or by moving the two layers counter-currently to each other. This can be conveniently done, for instance, by providing a very slight incline of, for example 3°–4°, to the trough with the aluminum layer being moved up the incline by means of a linear induction motor while the layer of titanium and/or boron compounds is permitted to flow down the incline against the flow of aluminum.

The titanium and boron compounds are used in the form of precursor compounds containing titanium and boron reducible by molten aluminum and are preferably in the form of salts, e.g. mixed double fluoride salts with an alkali metal. Potassium titanium fluoride and potassium boron fluoride are particularly preferred and these can be added either in particulate for or in molten form. They are normally added as a mixture in a titanium:boron ratio of 2:1 to 20:1. The grain refiner produced preferably contains about 5–6 wt % titanium and 0.08–1.2 wt % boron. A surface layer of spent reaction product in the form of spent salts or slag is removed downstream from the point of addition of the titanium and/or boron salts in the direction of flow of the titanium and/or boron salt layer.

The aluminum in the bottom layer is typically at a temperature in the range of about 680°-850° C., preferably 740°-760° C., and the reaction is normally completed during a contact time between layers of about 20-600 seconds, preferably 50-70 seconds.

According to another preferred embodiment of the invention, the aluminum alloyed with titanium and boron, after removal of the molten salt reaction product, is subjected to mixing in a separate vessel at a temperature in the range of about 750°-850° C., preferably 815°-835° C. The mixing is preferably done by an electromagnetic or mechanical stirring mechanism for at least five minutes.

According to another preferred embodiment of the invention, the layer of molten aluminum in the trough is subjected to gentle sub-surface stirring to encourage the interface reaction and to prevent settling of borides. Such stirring must be carefully controlled such as not to break the surface of the aluminum layer and can conveniently be done by means of an electromagnetic stirrer beneath the trough.

The aluminum grain refiner alloy obtained according to the process of this invention is itself also novel. It is an Al-Ti-B- grain refiner containing an improved structure and typically consisting of, in weight percent, 0.05 to 2 boron, 2 to 12 titanium and the balance aluminum plus normal impurities. The boron and titanium are present primarily as $TiAl_3$ and $TiB_2$ crystals, and in the grain refiner of this invention, the crystals are generally smaller and more uniform in size compared to existing commercial grain refiners. Thus, the $TiAl_3$ particles have a mean particle area of less than 13 $\mu m^2$ and substantially all of the $TiAl_3$ particles have an area of less than 5000 $\mu m^2$. Substantially all of the $TiB_2$ particles have sizes in the range of 0-1 $\mu m^2$.

BRIEF DESCRIPTION OF THE DRAWINGS

Certain preferred embodiments of the present invention are illustrated by the appended drawings in which:

FIG. 8 is a photomicrograph of a grain refiner produced by the present invention; and FIG. 9 is a photomicrograph of a commercially available grain refining alloy.

Figure 1:
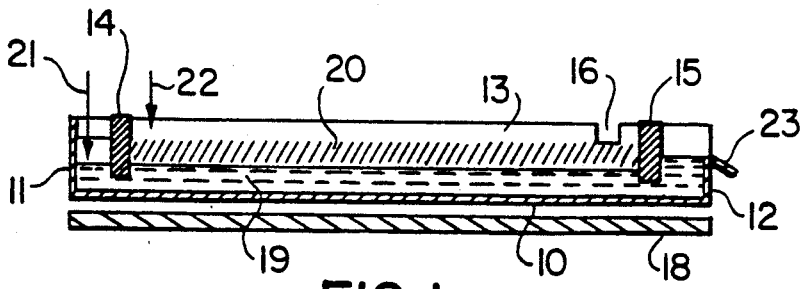
FIG. 1 is a schematic illustration of a reaction trough according to the invention.
Figure 2:
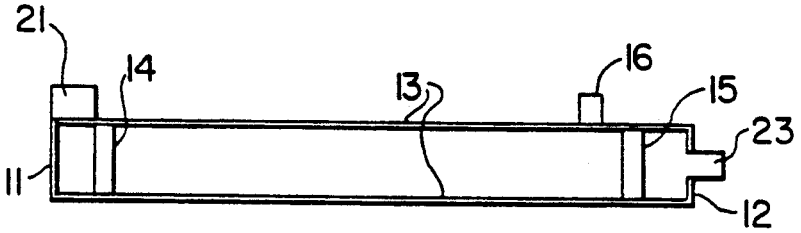
FIG. 2 is a plan view of the embodiment shown in FIG. 1.

The system shown in FIGS. 1 and 2 is very simple and consists primarily of a trough having a bottom wall 10, end walls 11 and 12 and side walls 13. A pair of baffles 14 and 15 extend laterally across the trough between the side walls 13 relatively near the end walls 11 and 12 respectively. A space is provided between the bottom of each baffle 14, 15 and the bottom wall 10 of the trough to permit flow of molten metal beneath the baffles.

An outlet 16 is provided in a side wall 13 of the trough for drawing off spent salt or slag product. Molten aluminum is introduced into the trough adjacent end wall 11 via inlet 21, while the titanium or boron salt is added through inlet 22 immediately downstream of the baffle 14. Molten aluminum alloy product is drawn off via outlet metal overflow 23 in end wall 12. A linear induction motor 18 extends along the length of the trough beneath bottom wall 10.

In operation, molten aluminum flows in through inlet 21 and passes beneath baffle 14 where it comes in contact with the titanium and/or boron salt 22. The aluminum and the salts remain as two separate and discrete layers, namely aluminum layer 19 and salt layer 20. Flows are adjusted so that the aluminum layer on the one hand and the titanium and/or metal salt layer on the other hand move at the same speed, or if desired, at different relative speeds along the length of the trough whereby optionally there may be relative movement between the layers along the interface. In this manner, reaction occurs along the length of the trough between baffle 14 and slag discharge 16. The aluminum alloy formed passes beneath the baffle 15 and is discharged out through metal overflow 23.

The linear induction motor 18 provides a gentle stirring or mixing of the aluminum layer 19 whereby the interface reaction is encouraged and borides are prevented from settling to the bottom of the trough.

Figure 3:
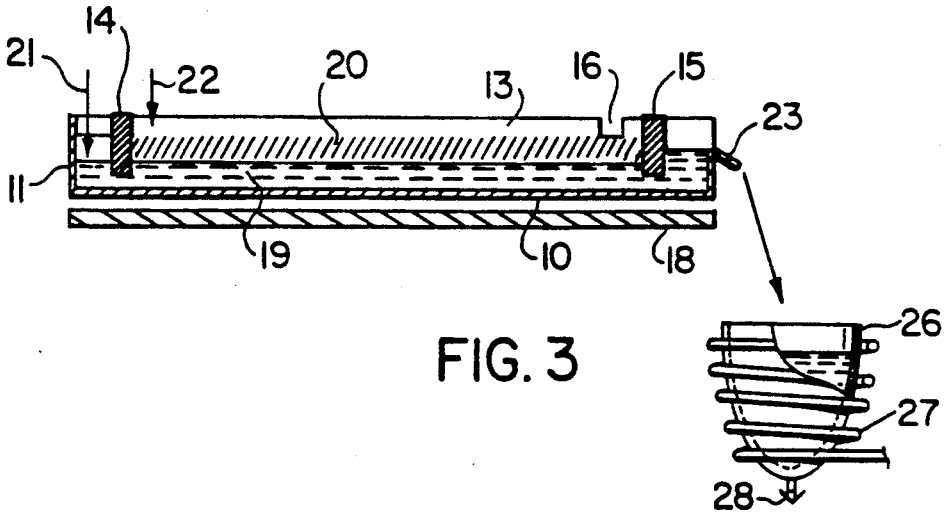
FIG. 3 is a schematic illustration of an alternative form of reaction system.

FIG. 3 shows an alternative embodiment which is generally similar to that of FIG. 1. However, the aluminum alloy product discharging via output overflow 23 discharges into a separate reaction vessel 26 where it is subjected to mixing for at least 5 minutes at a temperature in the range of about 750°-850° C. The mixing is done by means of electromagnetic mixer 27 and the final product is discharged through outlet 28 for casting.

Figure 4:
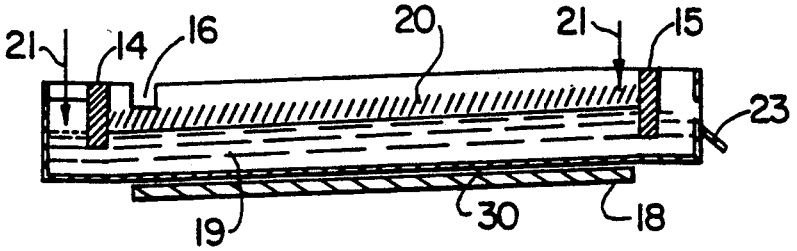
FIG. 4 is a schematic illustration of an incline reaction trough.

FIG. 4 shows an arrangement similar to that of FIG. 1, but with a sloping trough sectin 30 sloped at about 3°-4° to the horizontal. The molten aluminum inlet 21 is positioned at the lower end of the trough and is caused to flow up the slight incline by means of the linear induction motor 18. The inlet 22 for the titanium and/or boron salt is positioned at the high end of the inclined trough so that the salts may flow downwardly as a layer on top of the upwardly flowing layer of aluminum. In this manner, a countercurrent flow is achieved between the two layers.

Figure 5:
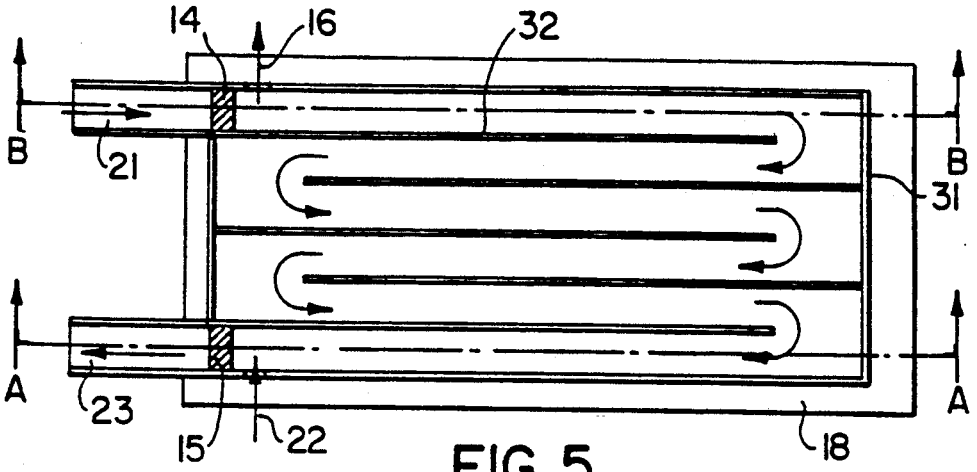
FIG. 5 is a plan view of a baffled trough.
Figure 6:
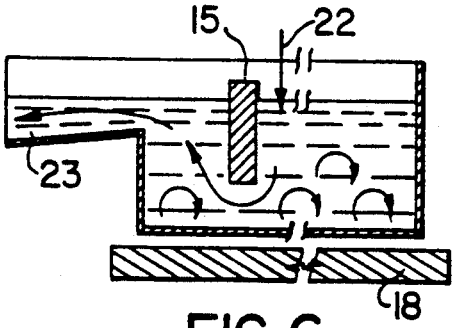
FIG. 6 is a partial sectional view along line A—A.
Figure 7:
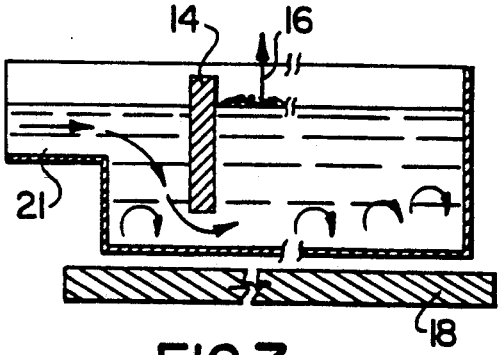
FIG. 7 is a partial sectional view along line B—B.

In order to lengthen the trough without requiring an excessive amount of floor space, a sinuous path may be set up as shown in FIGS. 5-7. This flow path is formed by arranging a series of baffles 32 within a rectangular vessel 31. The molten metal flows in through inlet 21 into one end of the flow path and the aluminum alloy product flows out through outlet overflow 23. The titanium and/or boron salt is added through inlet 22 downstream near the metal discharge and is caused to flow in a countercurrent direction through the sinuous path to be discharged at outlet 16 adjacent the molten metal inlet.

The above equipment may be manufactured from any of the usual refractory materials used for the processing of molten aluminum in the presence of molten salts, e.g. graphite or silicon carbide.

One preferrerd embodiment of the invention is illustrated by the following non-limiting example.

EXAMPLE

An aluminum grain refining master alloy containing titanium and boron was prepared using the apparatus of FIG. 1. Molten aluminum was flowed through the trough at a flow rate of 189 kg/hr and a mixed double salt consisting of a mixture of potassium titanium fluoride and potassium boron fluoride was added to the surface of the aluminum layer in proportions and amount to produce an aluminum grain refiner alloy containing 5 wt % titanium and 1 wt % boron.

The surface area of interaction between the salts and the molten aluminum was 0.2 $m^2$and the surface mass transfer was 16.0 kg $Al/m^2/min$. The aluminum in the bottom layer was at a temperature of 735° C. After removing the molten salt reaction product, the aluminum alloyed with titanium and boron was subject to mixing in a separate vessel at a temperature of 770°-775° C. for 16 minutes.

The grain refiner thus obtained was then subjected to image analysis using an optical microscope at a magnification of 50 diameters and the results were compared with those from image analysis of a commercially available aluminum grain refiner alloy containing 5 wt % titanium and 1 wt % boron. FIG. 8 shows a typical photomicrograph of a grain refiner alloy according to this invention and FIG. 9 shows a typical photomicrograph of a commercially available grain refiner alloy. In the photomicrographs, the coarse particles are $TiAl_3$ and the fine particles are $TiB_2$.

For the image analysis, thirty frames were studied and those included about 2000 particles. It was found that in the commercially available grain refiner alloy the $TiAl_3$ particles had a mean particle area of about 24.0 $\mu m^2$, with the largest $TiAl_3$ having an area of 36,000 $\mu m^2$, and the $TiB_2$ particles had sizes in the range of 0 to 2 $\mu m^2$. In the grain refiner alloys of this invention, the $TiAl_3$ paticles had a mean particle area of about 11.9 $\mu m^2$, with the largest $TiAl_3$ having an area of 3600 $\mu m^2$, and the $TiB_2$ particles had sizes in the range of 0 to 1 $\mu m^2$.

While the invention has been described in terms of preferred embodiments, the claims appended hereto are intended to encompass all embodiments which fall within the spirit of the invention.

We claim:

1. A process for the production of an aluminum grain refiner containing titanium and/or boron which comprises: (a) flowing a stream of molten aluminum as a bottom layer along a substantially horizontal trough, (b) continuously adding to the surface of the aluminum layer a titanium or boron compound reducible by aluminum or a mixture of such compounds, said titanium and/or boron compounds forming a discrete layer on top of the aluminum layer, (c) reacting the aluminum with the titanium and/or boron along the interface between the layers with sub-surface stirring of the molten aluminum, (d) continuously removing a surface layer of spent reaction product and (e) collecting a stream of aluminum alloyed with titanium and/or boron.

2. A process according to claim 1 wherein the layers flow countercurrent to each other.

3. A process according to claim 1 wherein the layers flow co-current to each other.

4. A process according to claim 1 wherein there is no relative movement between the layers.

5. A process according to claim 1 wherein there is relative movement between the layers.

6. A process according to claim 1 wherein the titanium and boron compounds are in the form of salts of said metals.

7. A process according to claim 6 wherein the salts comprise mixed double fluoride salts with alkali metals.

8. A process according to claim 6 wherein the salts are potassium titanium fluoride and potassium boron fluoride.

9. A process according to claim 6 wherein the salts are added in particulate form.

10. A process according to claim 6 wherein the salts are added in molten form.

11. A process according to claim 6 wherein the spent reaction product is removed downstrem from the point of addition of the titanium and/or boron salts in the direction of flow of the titanium and/or boron salt layer.

12. A process according to claim 1 wherein the titanium and boron compounds are added in a titanium:boron ratio of 2:1 to 20:1.

13. A process according to claim 6 wherein the aluminum layer is at a temperature of 680°-850° C.

14. A process according to claim 13 wherein the contact time between layers is about 20-600 seconds.

15. A process according to claim 13 wherein the stream of aluminum alloyed with titanium and boron is subjected to mixing in a separate vessel at a temperaturfe of 750°-850° C.

16. A process according to claim 1 wherein the subsurface mixing is carried out by means of a electromagnetic stirrer.

* * * * *